US006009814A

United States Patent [19]

Rossi

[11] Patent Number: 6,009,814

[45] Date of Patent: Jan. 4, 2000

[54] EXPANDABLE TABLE

[76] Inventor: Luis Rossi, 71 Williams Ave., San Francisco, Calif. 94124

[21] Appl. No.: 09/233,662

[22] Filed: Jan. 19, 1999

[51] Int. Cl.[7] ..... A47B 1/00

[52] U.S. Cl. ..... 108/66

[58] Field of Search ..... 108/66, 65, 67, 108/83, 89, 87

[56] References Cited

U.S. PATENT DOCUMENTS

| | | | |
|---|---|---|---|
| 254,388 | 2/1882 | Schultz . | |
| 340,176 | 4/1886 | Wardwell, Jr. . | |
| 351,101 | 10/1886 | Fauber . | |
| 838,671 | 12/1906 | Turner . | |
| 1,384,925 | 7/1921 | Seiler . | |
| 3,683,825 | 8/1972 | Sheldon | 108/33 |
| 4,782,764 | 11/1988 | Robinson | 108/90 |
| 4,809,619 | 3/1989 | Piretti | 108/115 |
| 5,156,095 | 10/1992 | Hansbaek et al. | 108/66 |
| 5,237,937 | 8/1993 | Peltier et al. | 108/66 |
| 5,425,313 | 6/1995 | Rowan | 108/65 |
| 5,568,775 | 10/1996 | Rizzi et al. | 108/65 X |

FOREIGN PATENT DOCUMENTS

| | | | |
|---|---|---|---|
| 2545160 | 4/1977 | Germany | 108/66 |
| 30248 | of 1911 | United Kingdom | 108/65 |

*Primary Examiner*—Jose V. Chen
*Attorney, Agent, or Firm*—Goldstein & Canino

[57] ABSTRACT

An expandable table, comprising a tabletop layer, a guide layer, an actuation layer, a central axis, and a base. The tabletop layer comprises a plurality of segments, each having a pair of segment sides which meet at a segment point. When the tabletop is in the retracted position, all segment sides correspond with segment sides of adjacent segments, and the segment points meet at the central axis of the table. The guide layer comprises a plurality of radial guide slots which equal in number the number of segments. The actuation layer comprises a plurality of arcuate slots which equal the guide slots and which spiral outward from and around the center. A vertical rod extends downward from each of the segments and engages one of the radial guide slots and one of the arcuate actuating slots. The position of each segment is thus at all times defined by the relative position of its associated guide slot and actuating slot. The guide layer and actuation layer are capable of relative rotary motion about the central axis to alter the relative position of the guide slots and actuating slots, and thus cause the segments to move radially inward or radially outward. Once the segments have been moved fully radially outward, leaves may be inserted between the segment sides to create an even, expanded tabletop surface.

7 Claims, 5 Drawing Sheets

EXPANDABLE TABLE

BACKGROUND OF THE INVENTION

The invention relates to an expandable table. More particularly, the invention relates to a table with a circular tabletop, which is capable of expanding for the insertion of leaves to thereby provide a larger, circular, even tabletop surface.

Selection of a dining room table is often a tradeoff between maximizing seating capacity and minimizing the floor space that the table occupies when not in use. For this reason, rectangular dining room tables have been made expandable for centuries. Generally, a rectangular dining table will slide apart from its middle, and allow one or more "leaves" to be inserted therein—resulting in a longer table. After use, the leaves are removed and the table is retracted to a smaller, storage size.

Although a circular table is desirable choice by many, it has the limitation in that it is fixed in size. There have been attempts, but no one has produced a way to effectively, neatly, and reliably expand a round table in order to increase its seating capacity. Thus, one must carefully choose a table by first determining whether it should be suited for seating four, six, or eight people.

Some others have conceived of table constructions which attempt to provide round expandable surfaces. Among these are U.S. Pat. Nos. 254,388 to Schultz; 340,176 to Wardwelt Jr.; 351,101 to Fauber; 838,671 to Turner; 1,384,925 to Seiler; 3,683,825 to Sheldon; 4,782,764 to Robinson; and 4,809,619 to Piretti. Many of these tables employ overlapping leaves which "fan" outward like a camera iris, clearly resulting in a uneven table surface. Others provide mechanisms which would be cumbersome to use, impractical or expensive to construct, or would likely fail after just a few uses.

U.S. Pat. No. 5,237,937 to Peltier shows an expansible table which employs a separate radial guide track and arcuate activating means. Because separate means are provided for causing the sectors to move radially outward and to guide the sectors outward in a straight, radial line, the design is limited in reliability, sturdiness, and the ability to be constructed with more than four sectors. Furthermore, the construction of the guide tracks using vertically overlapping pairs of guide members ensures that the tabletop will be, at best, unevenly supported.

While these units may be suitable for the particular purpose employed, or for general use, they would not be as suitable for the purposes of the present invention as disclosed hereafter.

SUMMARY OF THE INVENTION

It is an object of the invention to produce an expandable table which provides a flat, circular tabletop surface when in a retracted position, and may also be selectively expanded to create a flat, larger circular tabletop surface.

It is another object of the invention to provide an expandable table which selectively expands by turning the table upon the base. Accordingly, the table includes a tabletop layer which is made of sectors which all join at the center of the table. A guide layer and an actuation layer both extend beneath the tabletop layer, parallel thereto, and relative rotary motion thereof causes the sectors to selectively move radially outward when the actuation layer is rotated with respect to the base.

It is a further object of the invention to provide an expandable table which is simple and sturdy in construction so as to provide reliable operation. Accordingly, a single vertical rod extends downward from each leaf, and simultaneously engages both the guide layer and the actuation layer to both cause the sector to move outward, and to steady its movement in a straight radial path.

It is yet a further object of the invention that multiple sectors can be provided in a single table. Accordingly, the sectors each comprise a geometric sector of the circular tabletop. The number of sectors must correspond on a one-to-one basis with the number of guide slots in the guide layer, and the number of arcuate actuation slots in the actuation layer.

The invention is a expandable table, comprising a tabletop layer, a guide layer, an actuation layer, a central axis, and a base. The tabletop layer comprises a plurality of segments, each having a pair of segment sides which meet at a segment point. When the tabletop is in the retracted position, all segment sides correspond with segment sides of adjacent segments, and the segment points meet at the central axis of the table. The guide layer comprises a plurality of radial guide slots which equal in number the number of segments. The actuation layer comprises a plurality of arcuate slots which equal the guide slots and which spiral outward from and around the center. A vertical rod extends downward from each of the segments and engages one of the radial guide slots and one of the arcuate actuating slots. The position of each segment is thus at all times defined by the relative position of its associated guide slot and actuating slot. The guide layer and actuation layer are capable of relative rotary motion about the central axis to alter the relative position of the guide slots and actuating slots, and thus cause the segments to move radially inward or radially outward. Once the segments have been moved fully radially outward, leaves may be inserted between the segment sides to create an even, expanded tabletop surface.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
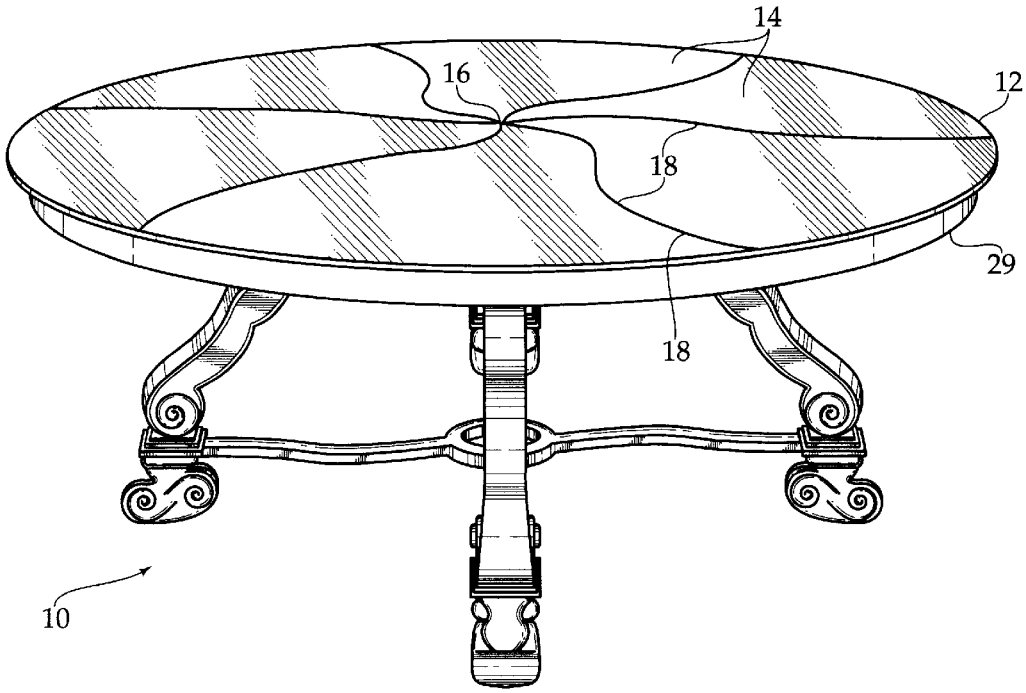
FIG. 1 is a diagrammatic perspective view, illustrating the table in a retracted position, wherein all sectors meet at the table center and all sector sides adjoin adjacent sectors.

FIG. 1 illustrates an expandable table 10 according to the present invention. The table includes a tabletop layer 12 which comprises a plurality of sectors 14 which all meet at a center point 16. Each sector has sector sides 18. The expandable table 10 is illustrated in FIG. 1 as being in a retracted position, wherein the sector sides 18 all correspond to sector sides 18 of adjacent sectors 14, and wherein the sectors 14 all meet at the center point 16.

Figure 2:
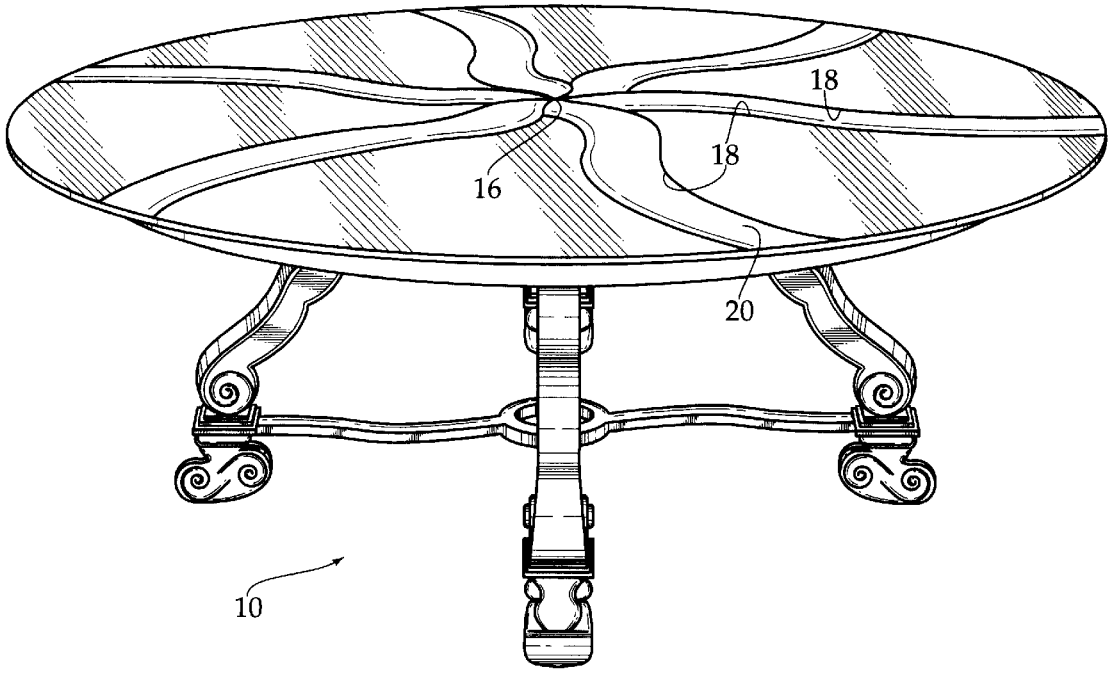
FIG. 2 is a diagrammatic perspective view, wherein the table of FIG. 1 has been expanded such that the sector sides of adjacent sectors have been moved apart from each other, and leaves have been inserted therebetween to create a continuous and even, but larger tabletop surface.

FIG. 2 illustrates the expandable table 10 in an expanded position: wherein the sector sides 18 are located a distance from the sector sides 18 of adjacent sectors 14; wherein all of the sectors 14 are located a uniform distance from the center point 16; and wherein leaves 20 are inserted between the sector sides 18, the leaves 20 all meeting at the center point 16, to create a continuous, flat, even, but larger tabletop surface. The manner in which the expandable table 10 moves from the retracted position shown in FIG. 1 to the expanded position of FIG. 2 will now the focus of the following discussion.

Figure 5:
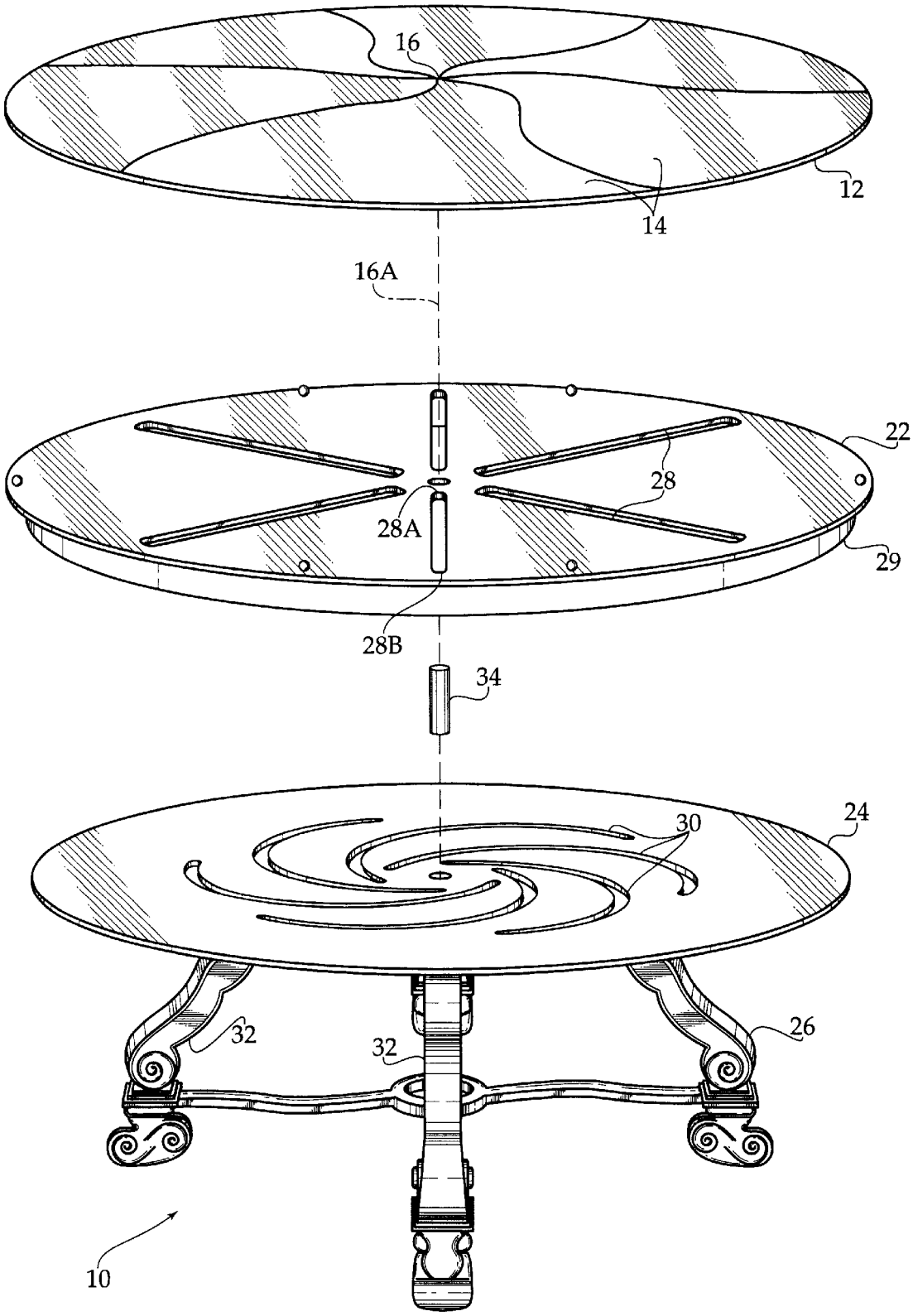
FIG. 5 is an exploded view of the table, illustrating the three major layers of the table, all arranged around the central axis of the table.

Jumping ahead to FIG. 5, various layers of the table 10 are shown, including the tabletop layer 12, a guide layer 22, and an actuation layer 24—which are all interconnected upon a base 26. The layers are illustrated as interconnected along a central axis 16A which travels through the table center 16 as previously described in the discussion of FIG. 1 and FIG. 2.

The guide layer 22 comprises a plurality of radial guide slots 28. The number of radial guide slots 28 corresponds in number to the sectors 14 that comprise the tabletop layer 12. Accordingly, one radial guide slot 28 is associated with each sector 14. Each radial guide slot 28 extends in a line that extends radially from the central axis 16A. However, each radial guide slot 28 actually begins an offset distance away from the central axis 16A. The fact that the radial guide slots 28 do not extend fully to the central axis 16A allows the guide slots 28 to be cut within a single piece of material, and thus allows the guide layer 22 to be substantially planar. Thus, the offset distance is chosen according to rigidity and strength characteristics of the material chosen for constructing the guide layer 22. The guide layer 22 has an outer perimeter and has an apron 29 attached thereto, extending downward near said outer perimeter.

Figure 6:
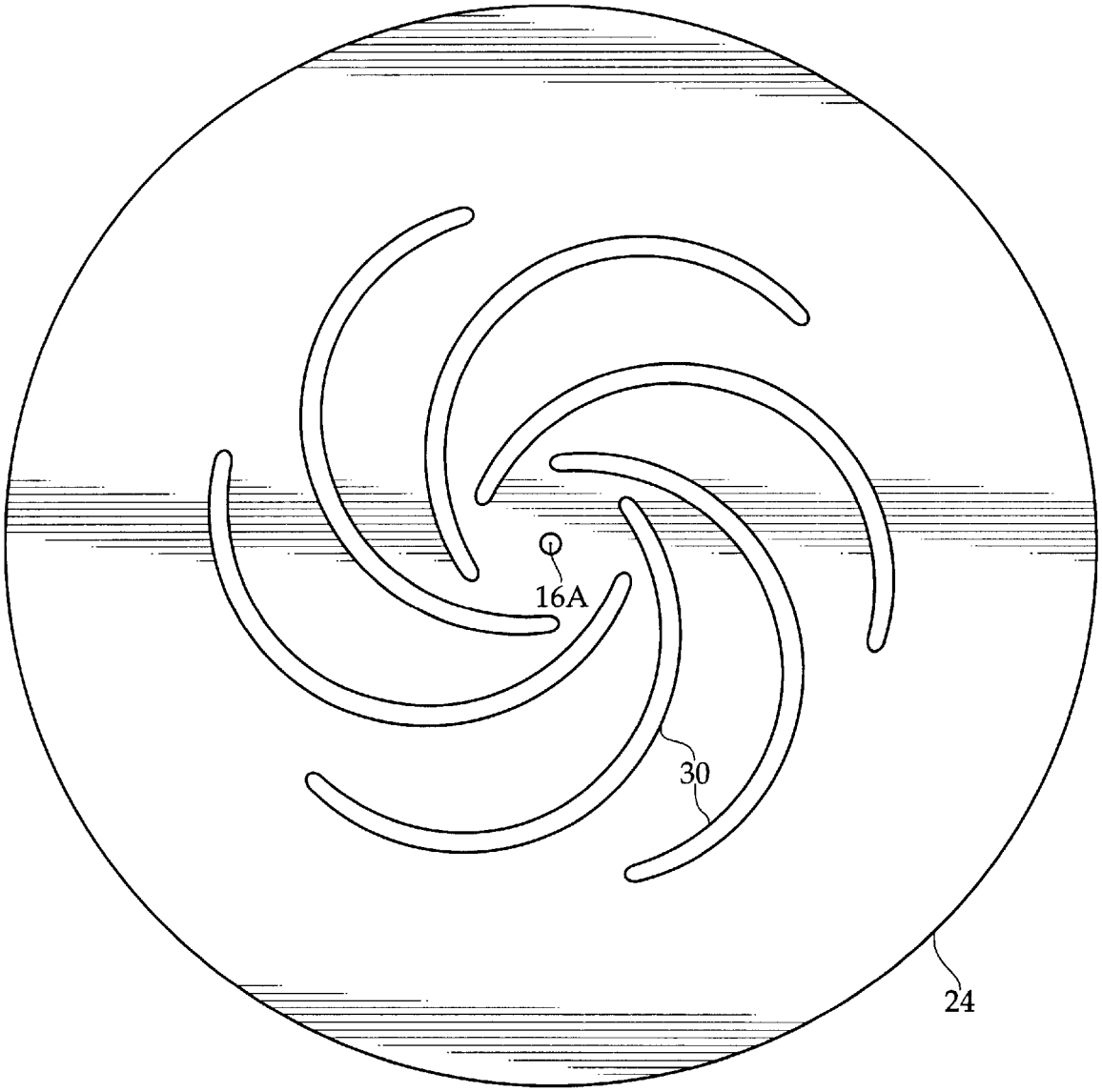
FIG. 6 is a top plan view of just the actuation layer of the table, illustrating the plurality of arcuate actuation slots that spirally radiate from the central axis of the table.

The actuation layer 24 comprises a plurality of arcuate actuation slots 30, which each spiral outward from the central axis 16A. Referring momentarily to FIG. 6, like the radial slots 28 in the guide layer 22, the arcuate actuation slots 30 also begin at the offset distance from the central axis 16A. The actuation layer 24 therefore also comprises a single piece of material, within which all the arcuate actuation slots 30 are cut.

The base 26 comprises a framework which includes a plurality of legs 32 and which supports the tabletop layer 12, the guide layer 22 and the actuation layer 24 primarily near the central axis 16A. According to the present invention, it is imperative that the guide layer and the actuation layer are capable of contrary rotation. But, it is not crucial which of these two layers actually rotates, and which is fixed in position. However, in a preferred embodiment, the actuation layer 24 is fixed to the base 26, and the guide layer 22 rotates thereupon. Thus although the actuation layer 24 does not move by the preferred embodiment, it nevertheless derives its name from the fact that the arcuate slots 30 provide the dynamic positioning necessary to create motion of the segments 14 when the guide layer 22 is rotated.

An axle mechanism 34 may be provided to selectively fix one of the layers to the base, while allowing the other to rotate with respect thereto. Preferably then, the axle mechanism 34 extends through the actuation layer 24 and allows the guide layer 22 to rotate thereon. It should be noted however, that the axle mechanism 34 can be alternately configured to fix the position of guide layer 22 with respect to the base, which allowing the actuation layer 24 to rotate between the base 26 and guide layer 22.

Figure 4:
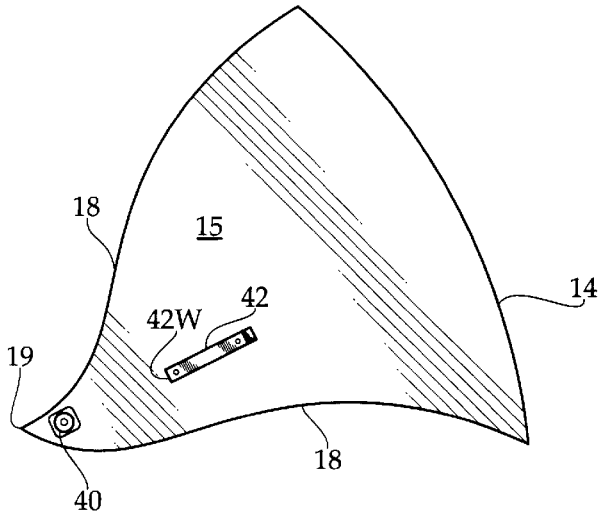
FIG. 4 is a bottom plan view of one of the sectors of the tabletop layer, illustrating the vertical rod and sliding guide block which allow effective interaction between the sector, guide layer, and actuation layer.

A bottom plan view of one of the sectors 14 is seen in FIG. 4, showing a sector bottom surface 15. As illustrated, the sector 14 has two sector sides 18, which meet at a sector point 19. A vertical rod 40 extends perpendicularly downward from the sector bottom surface 15, and is located near the sector point 19. The vertical rod 40 is actually located the offset distance from the sector point 19. A sliding guide block 42 is also mounted on the sector bottom surface 15. The sliding guide block 42 has a block width 42W which is substantially the same in width as the guide slot.

Figure 3:
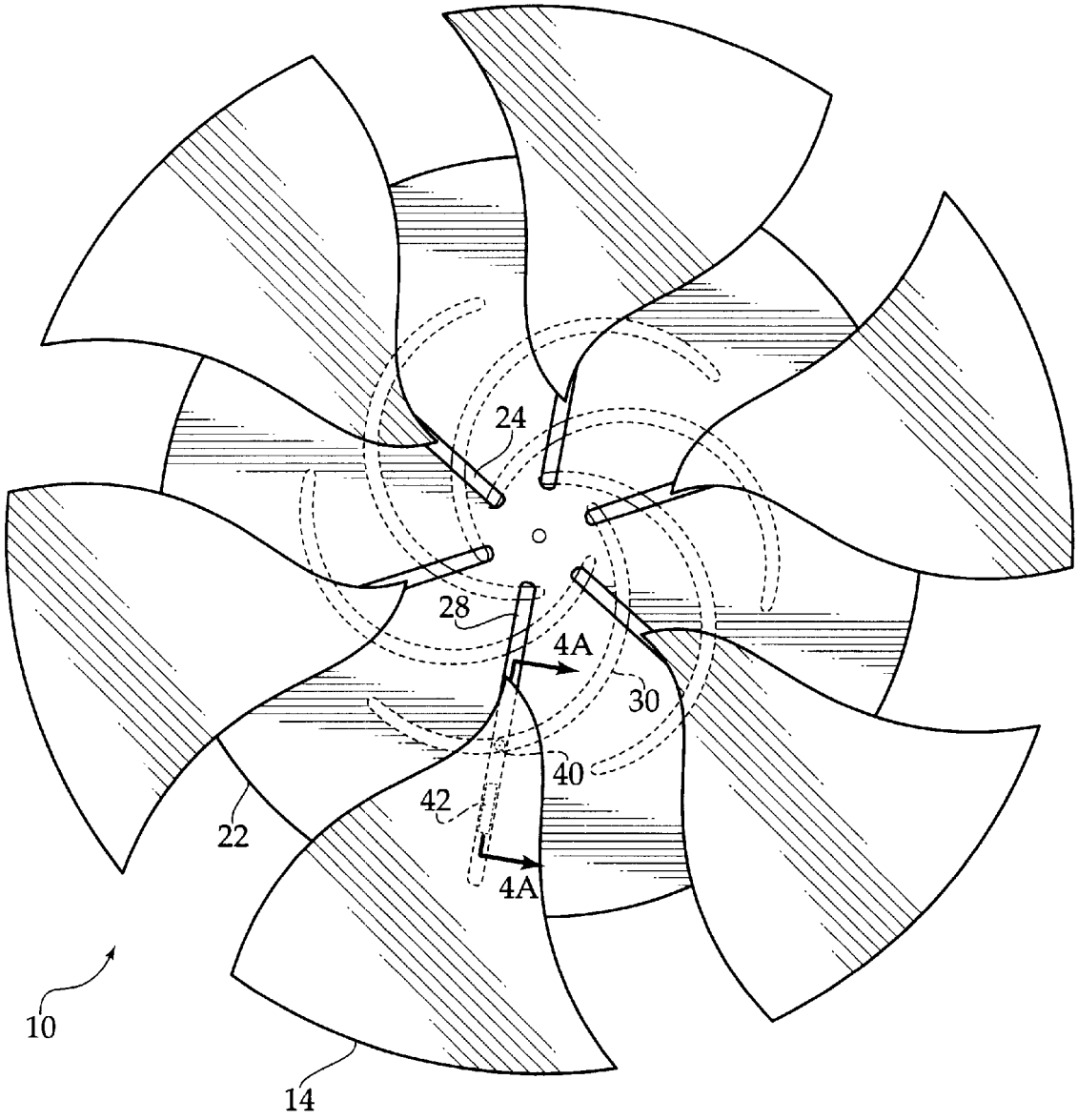
FIG. 3 is a top plan view, illustrating cooperative interaction between the tabletop layer, the guide layer and the actuation layer which allows the tabletop to expand and retract.

Referring now to FIG. 3, operation of the table 10 is illustrated. The guide layer 22 overlays the actuation layer 24, causing the guide slots 28 to cross the actuation slots 30. The vertical rod 40 from each of the sectors 14 simultaneously extends within one of the guide slots 28 and one of the actuation slots 30, so that at all times, the position of the sector 14 is defined by the point of intersection of that guide slot 28 and that actuation slot 30. Thus, since rotational movement of the guide layer 22 will move the point of intersection between the guide slot 28 and actuation slot 30 to a different radial position, said rotational movement will also cause the sector 14 to change radial positions. Additionally the guide block 42 extends in the guide slot 28 to steady the radial movement of the sector 14. Since each of the sectors is uniquely associated with one of the guide slots 28 and one of the actuation slots 30, all of the sectors 14 will together move radially inward or radially outward according to the rotation of the table, until either the vertical rod 40 reaches an innermost limit 28A (seen in FIG. 5) of its radial guide slot 28, or the guide block 42 reaches an outermost limit 28B (also seen in FIG. 5) of its radial guide slot 28.

Figure 4A:
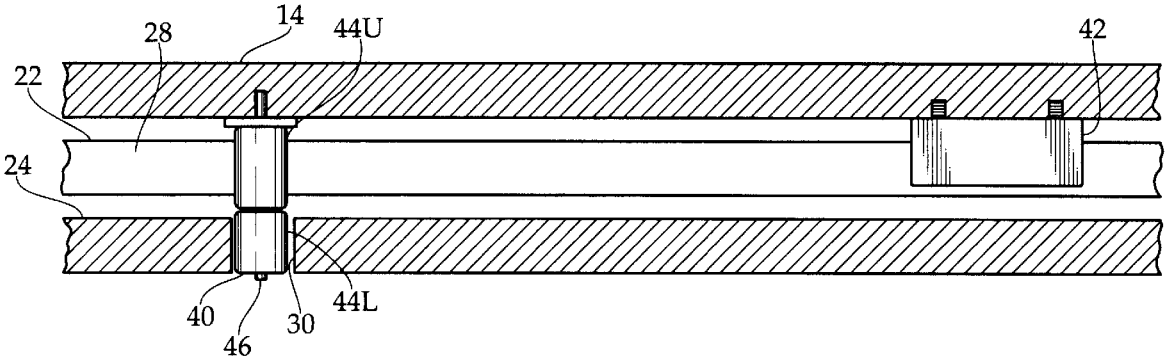
FIG. 4A is a cross sectional view, taken along line 4A—4A in FIG. 3, illustrating the sliding guide block engaging the radial guide slot, and illustrating the vertical rod engaging both the radial guide slot and the arcuate actuation slot.

FIG. 4A is a cross sectional view which helps fully illustrate the cooperative interconnection between the vertical rod 40 and guide block 42 of the sector 14 with the guide slot 28 and actuation slot 30 of the guide layer 22 and actuation layer 24, respectively. In particular, the vertical rod 40 comprises a stacked double roller, wherein each roller is capable of independent rotary motion upon a vertical pin 46. The stacked double roller comprises an upper roller 44U and a lower roller 44L. The upper roller 44U engages the guide slot 28, and the upper roller 44L engages the actuation slot 30. The guide block 42 extends within only the guide slot 28.

Referring to FIG. 6 momentarily, the arcuate actuation slots 30 are preferably positioned and shaped so that an approximately one hundred eighty degree rotation of the table will result in movement of the sector between its limits of travel. Referring to FIG. 1, the apron 29 is larger in diameter than the actuation layer (not seen). Thus, the apron 29 effectively shrouds the actuation layer and prevents clothing and skin from being pinched between the actuation layer and guide layer during expansion or retraction of the table.

Expansion of the table is thereby accomplished by relative rotary motion of the guide layer 22 with respect to the actuation layer 24, which is initiated by grasping the apron 29 of the guide layer 22. The rotation of the guide layer 22 moves the point of intersection between the guide slots 28 and actuating slots 30 radially outward, thus moving the segments 14 radially outward. Once the segments 14 are fully outward, the leaves are placed therebetween, completing the enlarged tabletop surface.

In conclusion, herein is presented an expandable table which comprises a plurality of wedge-like segments which may be selectively moved outward, and the spaces therebetween filled with leaves to complete an enlarged, even, smooth tabletop surface.

What is claimed is:

1. An expandable table, having a central axis, comprising:

a tabletop layer comprising a plurality of segments, each having a segment point, a segment position, and segment sides, when the table is in a retracted position the segment points all meet at the central axis and the segment sides all correspond with segment sides from adjacent segments;

a guide layer, substantially planar, having a plurality of radial guide slots, each extending radially outward from the central axis, the radial guide slots equal in number to the number of segments;

an actuation layer, substantially planar, having a plurality of arcuate actuating slots that are spirally arranged around the central axis and equal in number to the number of segments, each arcuate actuating slot has a corresponding radial guide slot and at all times has a relative position thereto;

a plurality of vertical rods, one vertical rod attached to and extending vertically downward from each segment, the vertical rod for each segment extending through one of the guide slots and through one of the actuating slots such that the position of the segment is at all times defined by the relative position of that guide slot and that actuating slot; and wherein the actuation layer and guide layer are capable of contrary rotation about the central axis to vary the relative positions of the actuating slots and guide slots to cause the segments to move toward the center and away from the center and thereby selectively move the segments toward a position where the segment sides do not correspond with segment sides from adjacent segments and wherein leaves may therefore be inserted between said segment sides of adjacent segments to create an even tabletop surface with the segments.

2. The expandable table as recited in claim 1, wherein each vertical rod comprises a double roller, including an upper roller and a lower roller, the upper roller engages the guide slot and the lower roller engages the actuation slot.

3. The expandable table as recited in claim 2, further comprising a plurality of sliding guide blocks, one associated with each segment, the sliding guide blocks mounted beneath the segments such that each sliding guide block extends in the radial slot associated with that segment to guide movement of the segment in a straight radial direction.

4. The expandable table as recited in claim 3, further comprising a base, wherein the actuation layer is rigidly mounted to said base and wherein the guide layer is rotatably mounted to said base by an axle mechanism extending on the central axis.

5. The expandable table as recited in claim 4, wherein the radial guide slots each radiate from the central axis but actually begin at an offset distance from the central axis, and wherein the vertical rod is located on the segment a distance from that segment point equal to the offset distance.

6. The expandable table as recited in claim 5, wherein the radial slots each have a radial slot width, wherein the guide blocks have a block width, and wherein the radial slot width for each radial slot is substantially equal to the block width in order to provide stable straight line motion of the segments.

7. The expandable table as recited in claim 6, wherein the guide layer has an outer perimeter which is larger in diameter than the actuation layer, and wherein an apron extends downward from the guide layer and shrouds the actuation layer.

* * * * *